US008882258B2

(12) United States Patent
Belbeck

(10) Patent No.: US 8,882,258 B2
(45) Date of Patent: Nov. 11, 2014

(54) WEB INKJET PRINTING METHOD AND APPARATUS USING AN AIR BAR

(75) Inventor: Jeffrey Belbeck, Mississauga (CA)

(73) Assignee: Delphax Technologies Inc., Bloomington, MN (US)

( * ) Notice: Subject to any disclaimer, the term of this patent is extended or adjusted under 35 U.S.C. 154(b) by 36 days.

(21) Appl. No.: 13/556,538

(22) Filed: Jul. 24, 2012

(65) Prior Publication Data

US 2013/0293649 A1 Nov. 7, 2013

Related U.S. Application Data

(60) Provisional application No. 61/642,291, filed on May 3, 2012.

(51) Int. Cl.

| | |
|---|---|
| ***B41J 2/01*** | (2006.01) |
| ***B41J 11/00*** | (2006.01) |
| *B41J 15/04* | (2006.01) |
| *B41J 3/60* | (2006.01) |

(52) U.S. Cl.

CPC ..... *B41J 11/002* (2013.01); *B41J 15/04* (2013.01); *B41J 11/0015* (2013.01); *B41J 3/60* (2013.01)

USPC ..... 347/102; 347/104

(58) Field of Classification Search

USPC ..... 347/102, 101, 104, 15, 21, 40

See application file for complete search history.

(56) References Cited

U.S. PATENT DOCUMENTS

| | | | | |
|---|---|---|---|---|
| 4,342,413 | A * | 8/1982 | Reba | 242/615.12 |
| 5,070,628 | A * | 12/1991 | Zagar | 34/644 |
| 5,464,143 | A * | 11/1995 | Hansen | 242/615.12 |
| 5,764,263 | A * | 6/1998 | Lin | 347/101 |
| 6,004,432 | A * | 12/1999 | Page et al. | 162/281 |
| 6,131,847 | A | 10/2000 | Theilacker et al. | |
| 6,302,353 | B1 * | 10/2001 | Motegi et al. | 242/615.12 |
| 6,364,247 | B1 | 4/2002 | Polkinghorne | |
| 6,916,132 | B2 * | 7/2005 | Otsuka et al. | 400/621 |
| 7,182,020 | B2 * | 2/2007 | Herbert | 101/228 |
| 7,311,234 | B2 * | 12/2007 | Solberg | 226/97.3 |
| 8,331,815 | B2 * | 12/2012 | Nishikawa | 399/53 |
| 8,584,489 | B2 * | 11/2013 | Chang et al. | 65/90 |
| 2004/0114945 | A1 * | 6/2004 | Takagi | 399/21 |
| 2004/0190970 | A1 | 9/2004 | Sasaki et al. | |
| 2005/0017123 | A1 * | 1/2005 | Meyer | 242/615.12 |
| 2006/0013951 | A1 * | 1/2006 | Yamada et al. | 427/211 |
| 2011/0043586 | A1 * | 2/2011 | Silverbrook et al. | 347/104 |
| 2011/0243634 | A1 * | 10/2011 | Kagami et al. | 400/582 |

* cited by examiner

*Primary Examiner* — Laura Martin
*Assistant Examiner* — Leonard S Liang
(74) *Attorney, Agent, or Firm* — Stuart L. Wilkinson

(57) ABSTRACT

In a method and apparatus for duplex inkjet printing on a web medium, a web medium is guided along an S-form transport path having generally horizontal top, middle and bottom spans and two turns linking the spans. One inkjet printhead is located to print onto a one surface of the web at the middle span and another inkjet printhead is located to print onto the opposite surface of the web at one of the other spans. To protect the printed surfaces before they are dried at least one of the turns in the S-form path is effected using an air bar to hold the printed web surfaces away from hard equipment surfaces.

8 Claims, 1 Drawing Sheet

WEB INKJET PRINTING METHOD AND APPARATUS USING AN AIR BAR

CROSS REFERENCE TO RELATED PATENTS

The present application claims priority under 35 USC 119 (e) to the provisionally filed U.S. application entitled, WEB INKJET PRINTING METHOD AND APPARATUS USING AN AIR BAR, having Ser. No. 61/642,291, and filed on May 3, 2012, the contents of which are expressly incorporated herein in its entirety by reference thereto.

FIELD OF THE INVENTION

This invention relates to duplex inkjet printing onto a web of paper or like medium.

DESCRIPTION OF RELATED ART

Systems for driving a continuous web of paper or like material past various stations are known. Such stations may include stations for preparing the surface of the paper with ink or some impregnating material to condition the paper for subsequent operations or to finish the paper for commercial sale and use. It is known to direct such a web along a path using rollers which may be drive rollers used to drive the web or idler rollers which may change the direction of the web. Rollers are contact elements and consequently, a web of paper or like material as it passes over a driven or idler roller will experience some pressure where it contacts the roller surface. To prevent degradation of print quality by smudging or spreading of the ink, a printed surface which will contact a roller in the course of paper feed is first dried by passing the web through a radiant heating station where the web passes between two banks of heat lamps. Typically, the lamps of the two banks are arranged vertically with the web being redirected upwardly from a horizontal printing orientation to a vertical drying orientation. The dryer fuser is preferably housed in a cabinet which is spaced from the printing zone in order that the dryer heat does not reach the printheads which might otherwise cause dehydration of the ink exposed at the printhead nozzles.

SUMMARY OF THE INVENTION

According to one aspect of the invention, there is provided duplex inkjet printing apparatus comprising first and second inkjet printheads for printing on opposite surfaces of a web medium, and a transport mechanism for transporting the web along an S-form transport path with generally horizontal top, middle and bottom spans and two turns linking the spans, the central span passing by the first printhead for downward printing by the first printhead onto one surface of the web medium, one of the top and bottom spans passing by the second printhead for downward printing by the second printhead onto the other surface of the web, at least one of the turns defined by an air bar.

According to another aspect of the invention, there is provided a method for duplex inkjet printing on a web medium, comprising guiding a web medium along an S-form transport path having generally horizontal top, middle and bottom spans and two turns linking the spans, operating a first inkjet printhead to print onto a first surface of the web at the middle span, operating a second inkjet printhead to print onto the opposite surface of the web at one of the top and bottom spans, and effecting at least one of the turns by means of an air bar directing air at a printed one of the surfaces.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

In known arrangements for printing of both sides of a web using, for example, a technique such as offset web lithography, the web is transported in a transport direction past successive printing stations. One side of the web is printed at a first of the stations and the web is passed through a dryer to dry the applied ink and the underlying paper substrate and then a cooler to cool the web and to make its reverse surface receptive for printing. The dried, cooled web is then printed at the second of the printing stations. For speed and ease of handling, the one surface of the web is printed from above while the reverse surface of the web is printed from below. Such an arrangement is not effective for ink jet printing. This sort of arrangement cannot be used in inkjet printing because ink droplets from an inkjet print head can only really be accurately applied if ink from the print head is directed downwardly so that the droplets are subjected to a combination of an ejection pressure to eject them from the print head nozzles coupled with the application of gravity as the droplets "fly" from the nozzles to the paper web.

Figure 1:
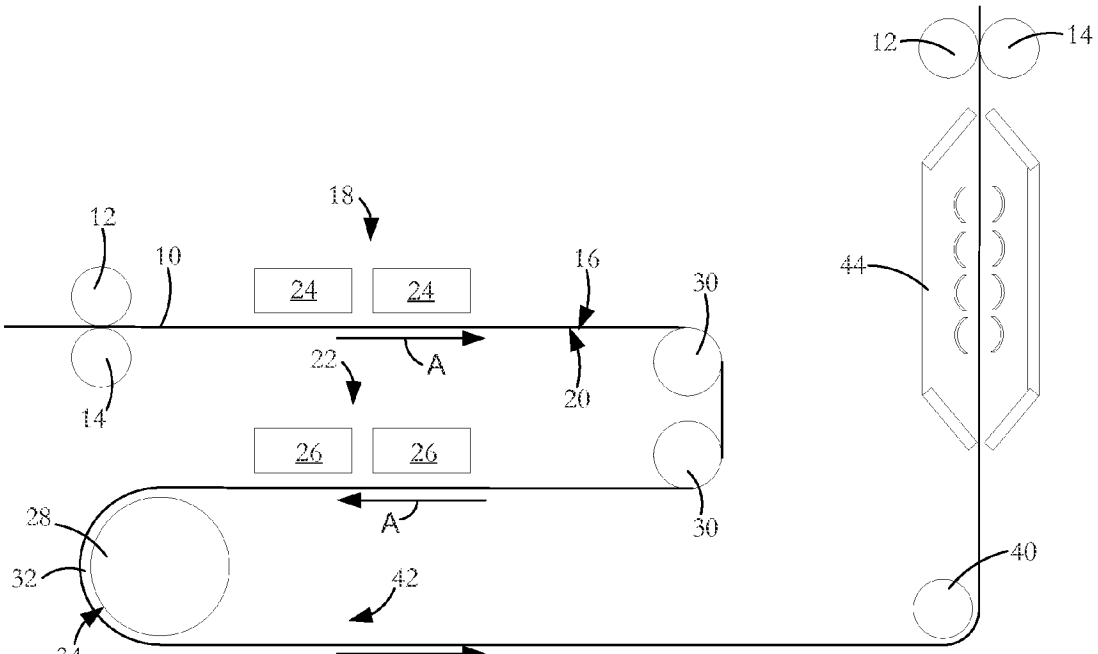
FIG. 1 is a side view of a duplex inkjet printing apparatus according to an embodiment of the invention.

Referring in detail to FIG. 1, there is illustrated inkjet printing apparatus for duplex printing on a paper web 10 according to an embodiment of the invention. The paper web 10 is driven along a transport path by a combination of a drive roller 12 and idler rollers 14. One surface 16 of the web is printed at a printing station 18 and the other surface 20 of the web is printed at a printing station 22. Each of the printed images may be a composite image obtained by having multiple printheads in tandem so that the printheads at each station each print a partial image which is in accurate registration with the partial images printed by the other tandem-mounted printheads. Such combination image printing is done for any of a number of reasons including achieving high web processing speeds, printing an image on a sheet with a large number of inks, and printing characters with a greater ink thickness, and therefore colour density or magnetic ink character recognition (MICR) signal strength, than can be achieved with a single print head. In this respect, the term "ink" is used to cover inks of different colour, primer materials for conditioning the paper to obtain quality print effects, water, and any other jettable substance that can contribute to the formation of an image on the paper web.

As is well-known, inkjet printer heads operate by ejecting droplets of ink onto the paper web. Such printers have print heads that are non-contact heads with ink being transferred during the printing process as minute "flying" ink droplets over a short distance of the order of ½ to 1 millimeter. Modern inkjet printers are generally of the continuous type or the drop-on-demand type. In the continuous type, ink is pumped along conduits from ink reservoirs to nozzles. The ink is subjected to vibration to break the ink stream into droplets, with the droplets being charged so that they can be controllably deflected in an applied electric field. In a thermal drop-on-demand type, the ink is subjected to rapid heating of a small volume of ink to form a vapour bubble which expels a corresponding droplet of ink. In piezoelectric drop-on-demand printers, a voltage is applied to change the shape of a piezoelectric material and so generate a pressure pulse in the ink and force a droplet from the nozzle. Of particular interest in the context of the present invention are inkjet print heads commercially available from Silverbrook Research, these being sold under the MEMJET® tradename which have a very high nozzle density, page wide array and of the order of five channels per print head. Such inkjet print heads have a high resolution of the order of 1600 dots per inch.

Unlike other printing techniques, an adequate image can only really be achieved by inkjet printing if the printheads print downwardly. Consequently, printheads 24, 26 at both the printing stations 18, 22 are oriented to print downwardly as shown in FIG. 1. To accommodate the two printing stations 18, 22 in a small footprint and to provide advantages through both being sited near commonly used ancillary equipment, the print stations 18, 22 are stacked generally vertically. In turn, as illustrated, an S-form transport path is adopted with the print station sites occupying two of the horizontal spans of the S-form and with the web being turned between adjacent spans. As shown in FIG. 1, the printing stations 18, 22 occupy the upper two horizontal spans of the S-form path but the stations could occupy the two lower spans in a different configuration according to an embodiment of the invention.

While functional turning of the web 10 can be achieved with conventional rollers, there is a risk of an image being damaged if the printed image contacts an idler roller surface downstream of a printing station. The image may be damaged by smudging if there is even a minute movement of the web relative to the idler roller surface. Or the image may be damaged by localized transfer of ink from the paper to the roller with associated problems of leaving detritus on the roller which may affect the quality of images on a downstream length of the web.

As illustrated in FIG. 1, following printing of the web surface 16 at the printing station 18, the web 10 is turned through substantially 180 degrees by means of two conventional rollers 30 to bring the web surface 20 under the printing station 22 to complete the duplex printing of the web. To effect a further 180 degree turn, air bar 28 is used so that the printed image on the surface 16 of the web, which may still be wet, is separated from any hard surface as the web rounds the 180 turn. Suitable air bars are available commercially from DMS, Inc., 570a Telser Road, Lake Zurich, Ill. 60047, USA. The design and operation of an exemplary air bar described and illustrated in U.S. Pat. No. 6,364,247 the contents of which are hereby incorporated by reference in their entirety and made part of the present United States Patent Application for all purposes. While the other turns in the S-form transport path are effected using conventional rollers 30 in the illustrated embodiment, air bars can be used at these turn sites if desired for other reasons. The or each air bar 28 is operated so as to generate a cushion of air 32 over an appropriately configured arc between the inside surface of the web 10 and an air emission surface 34 of the air bar so that the image printed on the surface 16 of the web is not damaged by a hard contact at the associated turn. The air pressure at the surface of the air bar 28 is selected in relation to the tension in the transported web 10 to maintain an air cushion gap of a desired width.

Figure 2:
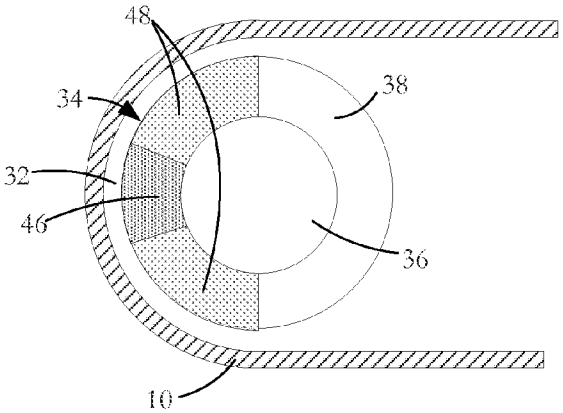
FIG. 2 is a sectional view of one form of air bar for effecting a web turn in the apparatus of FIG. 1

In an embodiment of the invention, the air bar is formed as a hollow cylindrical plenum 36, the plenum having walls 38 that are rendered porous by a matrix of micro-perforations extending through the walls. The micro-perforations act to transfer air that is pumped under pressure into the plenum 36 so that air expelled from the micro-perforations form the air cushion to maintain the moving web 10 in spaced relationship from the air bar surface 34. By using micro-perforations, the rate of escape of air around side edges of the web 10 is limited. This, in turn, limits the generation of air currents which are undesirable as they could cause deflection of flying droplets as they are transferred from the print heads 24, 26 to the paper surfaces. The air bar has an arc of porosity which depends on the angle of turn of the web. In the illustrated embodiment, there is a turn of 180 degrees at the air bar 28 and a further turn of 90 degrees at an air bar 40 to lead the web 10 from an output zone 42 to a drying unit 44. The porous regions within the walls of the air bars 28 and 40 are on the order of 180 degrees and 90 degrees respectively to match the turn angles. In addition, as shown in the sectional view of FIG. 2, the porosity of plenum wall 38 at the arcuate active region varies from a central region 46 towards flanking outer regions 48. The variation is shown as a sudden variation but can be a phased variation. The porosity profile is such as to encourage a lower air flow at the central region 46 compared with the flanking regions 48 so as to maintain a desired turn profile in the web 10 as it is turned at the air bar 28. In one specific implementation of the above described embodiment, a tension in the paper web 10 in the order of 0.5 to 1 pound per inch of paper width was maintained, resulting in 10 to 20 pounds of tension in a 20 inch wide web. The air pressure within the air bars 28, 40 was measured at about 20-25 psi with air consumption for 20 inch wide paper being about 3.6 cubic feet per minute.

It will be appreciated that using an air bar to turn paper at a wet image obviates a dryer and cooler that would normally be required immediately downstream of a printing station to stabilize the first printed surface before the reverse surface can be printed. By using the air bar 28 with the stacked printhead configuration, the first printed surface 16 can remain wet while the second surface 20 is being printed so that only one downstream drying unit 44 is required. In the embodiment shown in FIG. 1, after the reverse surface of the web is printed at the inkjet print head array, the web is turned through a 90 degree turn and is driven though the drying unit.

For convenience, the drying unit/fuser 44 is mounted so that the paper web 10 is driven vertically through the drying zone. The drying unit 44 has two banks of heat lamps such as tungsten filament lamps to emit short wavelengths and carbon filament lamps to emit longer wavelengths. The lamps radiate heat at the respective surfaces of the web 10 as the web passes between the two banks. The heating elements and optional reflectors are rated and positioned so as to achieve distributed drying/fusing action over the area of the printed image but without causing high intensity heating of the paper and printed ink which might otherwise cause deterioration of the image or damage to the paper. If the web has to be stopped temporarily, the heat lamps are switched off or redirected to protect the paper and the images. Alternative forms of drying unit/fuser from the heat lamp arrangements illustrated are envisaged for use in the context of other embodiments of the invention. As an adjunct to the dryer, the air bar (or air bars if used at more than one turn) can use heated and or dried air to provide preliminary drying of the associated surface of the web.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. Duplex inkjet printing apparatus comprising a transport mechanism for transporting a web medium along a transport path, the transport path having a generally S-form section having generally horizontal top, middle and bottom spans and turns linking adjacent spans, a first inkjet printhead at the top span for downward printing onto one surface of the web medium, a second printhead at the central span for downward printing onto the other surface of the web, the turn between the central span and the bottom span using a first air bar, the transport path having a generally vertical section downstream of the bottom span with a turn using a second air bar linking the bottom span and the generally vertical section, and a single web drying unit having radiant drying elements positioned to dry both surfaces of the web at the generally vertical section.

2. Printing apparatus as claimed in claim 1, the air ban being porous structure type air bars.

3. Printing apparatus as claimed in claim 1, at least one of the air bars having an air jet emission zone, the zone extending around the air bar through an angle substantially equal to the angle through which the web is turned at the air bar.

4. Printing apparatus as claimed in claim 3, the air jet emission zone of at least one of the air bars having an entry region where the moving web is first turned on the air bar, a central region around which the moving web is driven, and an exit region where turning of the moving web is completed, the air jet emission zone at the central region having a lower air flow than the air jet emission zones at the entry and exit regions.

5. A method for duplex inkjet printing on a web medium, comprising guiding a web medium along an S-form transport path section having generally horizontal top, middle and bottom spans and turns linking adjacent spans, the turn between the middle and the bottom span using a first air bar, operating a first inkjet printhead at the top span to print downwardly onto a first surface of the web, operating a second inkjet printhead at the central span to print downwardly onto the opposite surface of the web turning the web from the bottom span to a generally vertical transport path section using a second air bar, and operating a single web drying unit having radiant drying elements positioned on each side of the vertical transport path section to dry the surfaces of the web.

6. A method as claimed in claim 5, at least one of the air bars being of the porous type generating an air cushion by forcing jets of air through a matrix of micro-perforations.

7. A method as claimed in claim 5, further comprising at least one of the air ban emitting jets of air over an arc substantially the same as an arc of turn of the web at the air bar.

8. A method as claimed in claim 7, further comprising at at least one of the air bars, developing an air cushion having an entry region where the moving web is first turned at the air bar, a central region around which the moving web is driven, and an exit region where the moving web moves away from the air bar after completing the turn, and developing such air cushion to have an air flow at the central region that is different from the air flow at at least one of the entry and exit regions.

* * * * *